United States Patent [19]

Dougherty et al.

[11] Patent Number: 4,686,416

[45] Date of Patent: Aug. 11, 1987

[54] COLOR CRT FRONT ASSEMBLY WITH TENSION MASK SUPPORT

[75] Inventors: Lawrence W. Dougherty, Sleepy Hollow; Paul Strauss, Chicago, both of Ill.

[73] Assignee: Zenith Electronics Corporation, Glenview, Ill.

[21] Appl. No.: 831,699

[22] Filed: Feb. 21, 1986

[51] Int. Cl.[4] ..... H01J 29/07; H01J 29/88

[52] U.S. Cl. ..... 313/407; 313/408; 313/479; 313/472; 313/284

[58] Field of Search ..... 313/407, 482, 408, 403, 313/269, 286, 284, 479, 466, 472

[56] References Cited

U.S. PATENT DOCUMENTS

| | | | |
|---|---|---|---|
| 3,632,339 | 1/1972 | Khan | 313/472 X |
| 3,792,300 | 2/1974 | Benda et al. | 313/479 X |
| 4,072,876 | 2/1978 | Morrell | 313/403 |
| 4,495,437 | 1/1985 | Kume et al. | 313/407 X |
| 4,547,695 | 10/1985 | Rath | 313/407 X |
| 4,595,857 | 6/1986 | Rowe et al. | 313/407 |
| 4,605,879 | 8/1986 | Rath | 313/407 |

*Primary Examiner*—Palmer C. DeMeo

*Attorney, Agent, or Firm*—Ralph E. Clarke, Jr.

[57] ABSTRACT

A front assembly for a color cathode tube is disclosed. The tube faceplate has on its inner surface a centrally disposed screen area for receiving process materials during the spin-application process. The front assembly has a shadow mask support structure secured to the inner surface of the faceplate on opposed sides of the screen area. The structure has a first surface for receiving and securing a foil shadow mask, and a second surface inclined from the first surface to the screen area effective to conduct from the screen area any excess of coating material applied during the spin-application process. As a result, discontinuities in phosphor application visible to the viewer, and non-adherence of phosphor resulting in wash-off and flake-off, are avoided. An embodiment is also shown in which electrical connection is made between a mask support structure and a screen.

9 Claims, 7 Drawing Figures

COLOR CRT FRONT ASSEMBLY WITH TENSION MASK SUPPORT

CROSS-REFERENCE TO RELATED APPLICATIONS

This application is related to but in no way dependent upon copending applications Ser. No. 538,001 filed Sept. 30, 1983; Ser. No. 538,003 filed Sept. 30, 1983; Ser. No. 572,088, filed Jan. 18, 1984, now U.S. Pat. No. 4,547,696; Ser. No. 572,089, filed Jan. 18, 1984; Ser. No. 725,040, filed Apr. 19, 1985; Ser. No. 729,015; filed May 17, 1985; Ser. No. 758,174, filed Jul. 23, 1985; Ser. No. 832,559, filed Feb. 21, 1986; Ser. No. 832,493, filed Feb. 21, 1986; and Ser. No. 832,556, filed Feb. 21, 1986, all of common ownership herewith.

BACKGROUND OF THE INVENTION

This invention relates generally to color cathode ray picture tubes and is addressed particularly to a front assembly for use in the manufacture of color tubes that have a tension foil shadow mask. The invention is applicable to the manufacture of tension mask tubes of various types including those intended for home entertainment television receivers and medium-resolution and high-resolution tubes for color monitors.

A color cathode ray tube typically has three electron guns arranged in a delta or an in-line configuration. Each gun projects an electron beam through the apertures of a "shadow mask" onto assigned target areas located on the inner surface of the faceplate. The target areas comprise patterns of phosphor deposits typically arranged in triads of dots or lines. Each of the triads consists of a deposit of a red-light-emitting, green-light-emitting, and blue-light-emitting phosphor which are excited to luminescence under bombardment by the respective electron beams. To increase the apparent brightness of the display, and to minimize the incidence of color impurities that can result if a beam falls upon an unassigned phosphor deposit, the target area may include a layer of darkish, light-absorbing material termed a "grille," and its composition is referred to as "grille dag." The grille dag separates the dots or lines, and serves as a guard band in case of beam mis-registration. The grille dag is also electrically conductive, unlike the phosphor deposits.

The front assembly of a color cathode ray tube essentially comprises the faceplate with its deposits of the grille dag and the light-emitting phosphors, a shadow mask, and a support structure for the mask. As is well known in the art, the shadow mask acts as a color-selection electrode, or parallax barrier, that ensures that each of the three beams lands only on its assigned phosphor deposits. As used herein, the term shadow mask means the "tension foil shadow mask," which comprises an apertured metallic foil which may, by way of example, be about one mil or less in thickness. This type of mask must be supported in high tension a predetermined distance from the inner surface of the cathode ray tube faceplate; this distance is known as the "Q"-distance.

The physical requirements for the tension foil shadow mask support structure are stringent. As the shadow mask is mounted under high tension, the structure must be of high strength so that the mask is held immovable—an inward movement of the mask as little as one-tenth of a mil can result in loss of guard band and consequent color impurities. Also, the mask support structure must be of such configuration and material composition as to be compatible with the means to which it is secured. For example, the mask support structure is attached to glass such as the glass of the inner surface of the faceplate, so it is essential that the material from which the structure is made have about the same thermal coefficient of expansion as that of the glass so the glass will not crack as a result of thermal stress. Also, the mask support structure must be of such composition that the mask can be securely fastened to it, as by electrical resistance or laser welding, for example. And the mask support surface is preferably of such flatness as to minimize voids between the metal of the mask and the mask support structure which might prevent the intimate metal-to-metal contact required for welding.

As noted, the screen area receives process coating materials in the form of the grille and the light-emitting phosphors. These materials are typically deposited by a photoprinting process. The screen area of the inner surface of the faceplate is first coated with a fluidized material that constitutes the grille, and which hardens upon drying. The shadow mask, mounted on a rigid frame, is temporarily installed in precise relationship to the faceplate, and the grille coating is exposed to light actinic to the coating projected through the apertures of the mask from a light source located at a position that corresponds to the beam-emission point of the associated electron gun of the end-product tube. The faceplate is then separated from the shadow mask and the coating is "developed," resulting in a pattern of openings in the grille. The light-emitting phosphors are then sequentially deposited in respective grille openings by a repetition of the same process. The final product is a faceplate having on its inner surface a pattern of triads of dots or lines capable of emitting, upon electron beam excitation, red, green or blue light.

The deposits on the inner surface of the faceplate of the cathode ray tube are typically covered with a conductive film of aluminum. The aluminizing process comprises the deposition of an electron-pervious metallic film; that is, a film trasnparent to the flow of electrons comprising the three beams. The film increases the brightness of the display by acting as a mirror to reflect toward the viewer the visible light produced by the phosphors when activated by the beams. The film also carries the high-voltage charge to act as an electron-attractive ultor electrode for the display. The thickness of the film is typically about 2,000 Angstroms.

The process coating materials such as the grille coating and the phosphors for each color are typically applied in the form of screening fluids commonly referred to as "slurries." A slurry is conventionally applied to the screen area by a process known as the "radial flow suffusion," or as it is referred to herein, the "spin-application process." In this process, the screening fluid is poured onto the faceplate as it is rotated. The fluid spreads to the edges of the panel under the influence of centrifugal force, and excess fuid is cast off from the faceplate perimeter. If there is any obstacle to the free flow of the slurry during the spin-application process, the out-rushing slurry will "wash back" from the obstacle, resulting in thickened wave patterns in the coating which become fixed upon drying. The effect of the wave patterns is a non-uniformity in phosphor density thickness that can become cumulative as the process coating materials are successively applied. The presence of such wave patterns results in discontinuities in coating thickness visible to the viewer as dark areas on the screen. Also, underexposure of the coating in thickened areas during the photoscreening process can result in non-adherence of the phosphor and consequent phosphor wash-off and flake-off.

U.S. Pat. No. 3,894,321 to Moore, of common ownership herewith, is directed to a method for processing a color cathode ray tube having a foil mask sealed in tension directly to the bulb. Included in that disclosure is a description of the sealing of a foil mask between the junction of the skirt of the faceplate and the funnel. The mask is shown as having two or more alignment holes near the corners of the mask which mate with alignment nipples in the faceplate. The nipples pass through the alignment holes to fit into recesses in the funnel. In another Moore embodiment, the front panel is shown as having a continuous ledge around the inner surface of the faceplate. The top surface of the ledge is spaced a Q-distance away from the faceplate for receiving a foil mask such that the mask is sealed within the tube envelope. In yet another embodiment, two ledges are located at the sides of the faceplate parallel with the vertical axis of the faceplate for receiving a shadow mask. Also shown is an embodiment in which the faceplate is skirtless and essentially flat.

Other prior art: Strauss—4,547,696; Palac—4,100,451; Lerner—4,087,717; Schwartz—4,069,567; Dougherty—4,045,701; Steinberg et al—3,727,087; Oess—3,284,655; Hackett et al.—3,030,536; Vincent—2,905,845; Fischer-Colbrie—2,842,696; Law—2,625,734; and "The CBS Colortron: A color picture tube of advanced design." Fyler et al. Proc. of the IRE, Jan. 1954.

OBJECTS OF THE INVENTION

It is a general object of the invention to provide an improved front assembly for tension foil shadow mask tubes.

It is a less general object of the invention to provide enhanced quality and reliability in color cathode ray tubes that utilize the tension foil shadow mask.

It is an object of the invention to provide means for facilitating the disposition of process coating materials on the faceplate of tubes having a structure for supporting a tension foil shadow mask.

It is an object of the invention to provide for uniformity in phosphor density in the manufacture of cathode ray tubes having the tension foil shadow mask.

It is another object of the invention to provide means for positive adherence of process materials such as phosphors in the manufacture of tension foil shadow mask cathode ray tube.

It is yet another object of the invention to provide for electrical interconnection between certain components of the front assembly of tubes having the tension foil shadow mask.

BRIEF DESCRIPTION OF THE DRAWINGS

The features of the present invention which are believed to be novel are set forth with particularity in the appended claim. The invention, together with further objects and advantages thereof, may best be understood by reference to the following description taken in conjunction with the accompanying drawings, in the figures of which like reference numerals identify like elements, and in which:

DESCRIPTION OF THE PREFERRED EMBODIMENT

Figure 1:
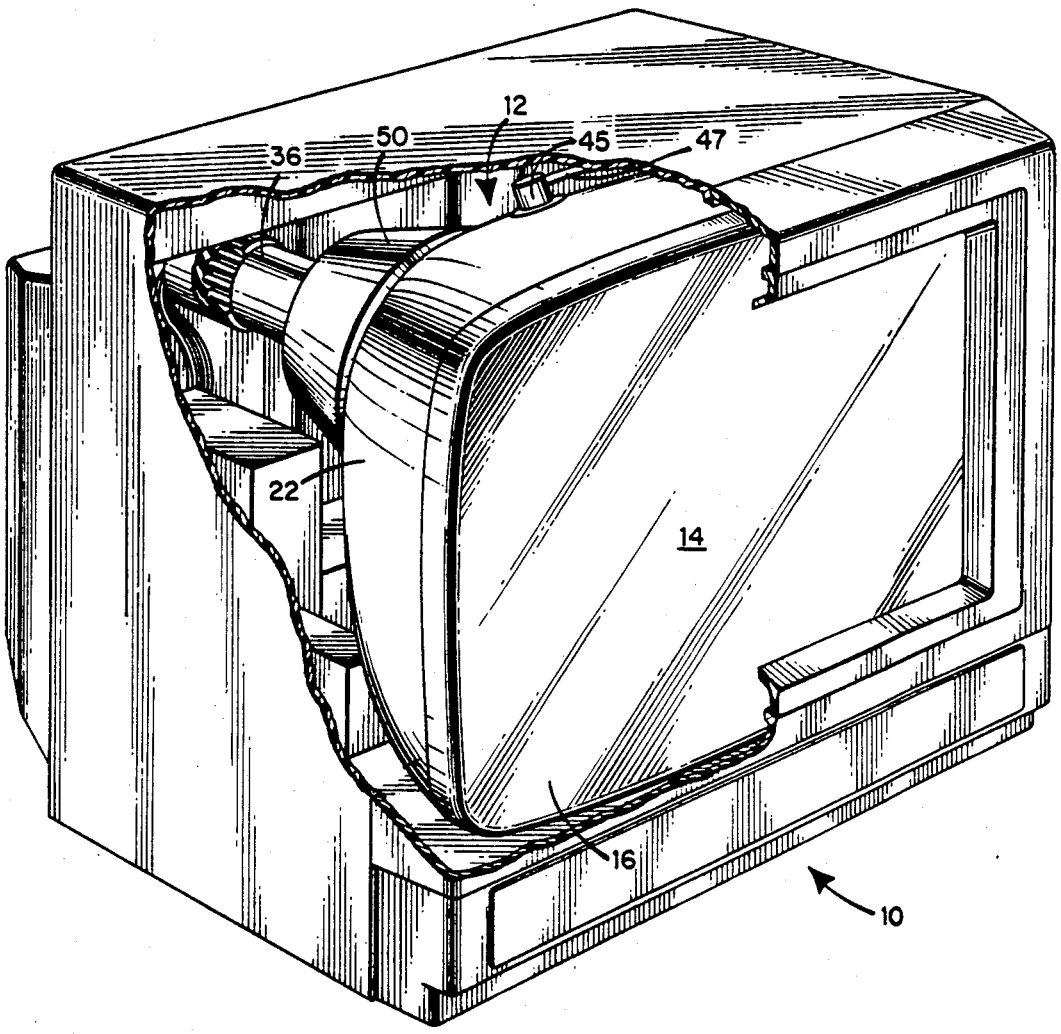
FIG. 1 is a cut-away view in perspective of a cabinet that houses a color cathode ray tube which incorporates a front assembly according to the invention, with a depiction of major components of the tube.

FIG. 1 depicts a video monitor 10 that houses a color cathode ray tube 12. The design of the video monitor is the subject of copending design patent application Ser. No. 725,040 of common ownership herewith. The monitor-associated tube 12 is notable for the relatively flat imaging area 14 that makes possible the display of images in undistorted form. Imaging area 14 also offers a more efficient use of screen area as the corners are relatively square in comparison with the more rounded corners of the conventional cathode ray tube.

Figure 2:
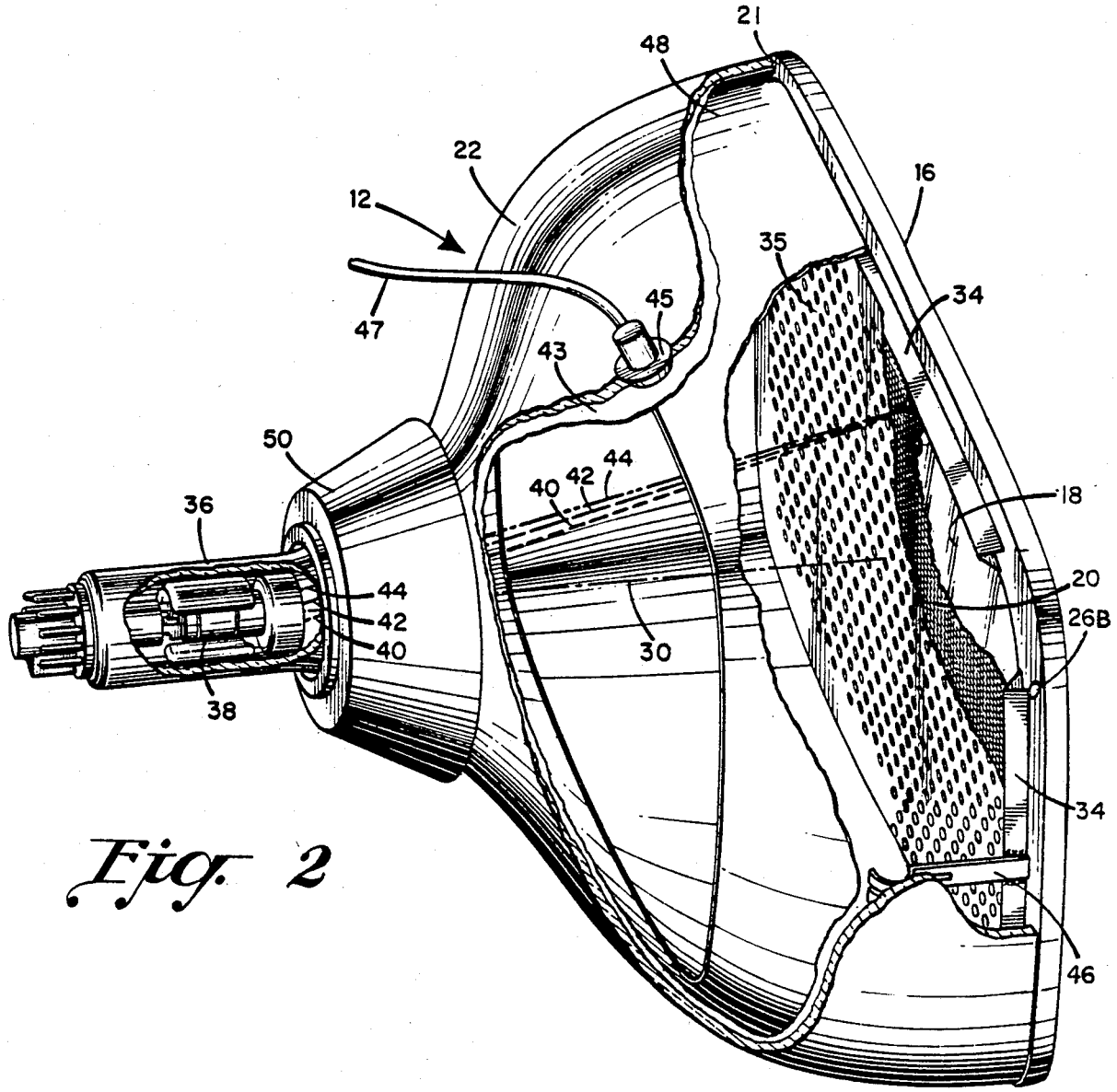
FIG. 2 is a side view in perspective of the color cathode ray tube of FIG. 1 showing another view of components depicted in FIG. 1, together with cut-away sections that show the relationship of the front assembly according to the invention with other tube components.
Figure 2A:
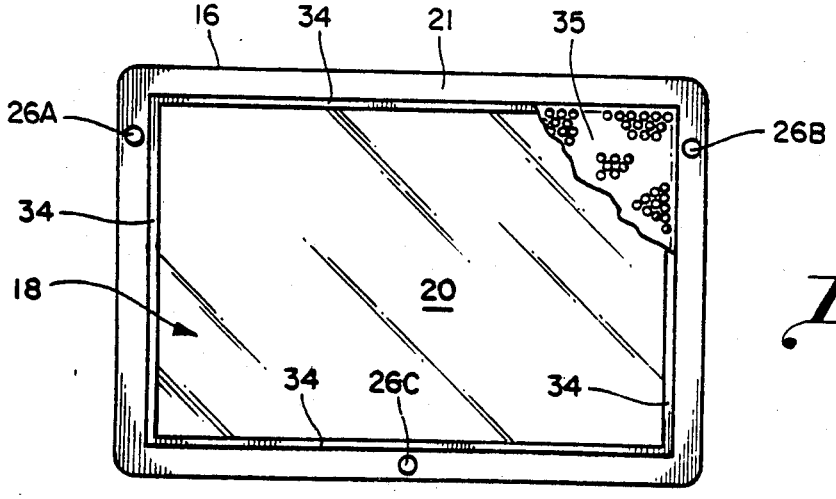
FIG. 2A is a plan view of the inner surface of the faceplate shown by FIG. 2, indicating the location and orientation of components of a front assembly according to the invention.
Figure 3:
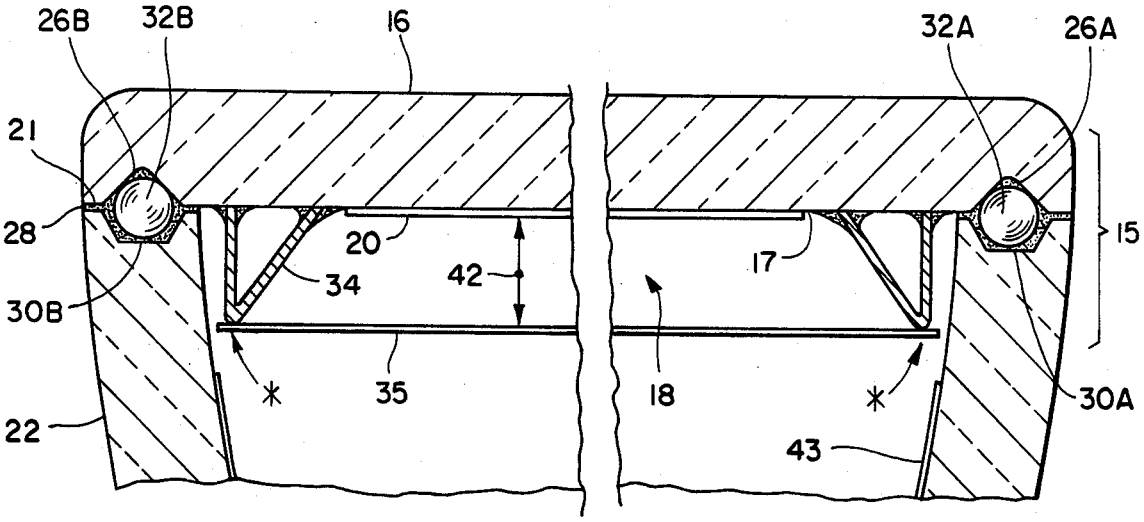
FIG. 3 is a view in elevation of a conjoined faceplate and a funnel sectioned at a 120-degree azimuthal interval, and showing in greater detail a front assembly according to the invention following its installation in a cathode ray tube.

With reference also to FIGS. 2, 2A and 3, a front assembly 15 for a color cathode ray tube is depicted, the general scope of which is indicated by the bracket in FIG. 3. This front assembly essentially comprises the assembly-in-process according to the invention as it is embodied in tube 12. The front assembly 15 includes a glass faceplate 16 which may be flat, or alternately, substantially flat in that it may have finite horizontal and vertical radii. Faceplate 16, depicted as being planar and flangeless, is represented as having on its inner surface 18 a screen 20. Screen 20 has deposited thereon the grille and the pattern of phosphor deposits.

Screen 20 is surrounded by a peripheral sealing area 21 adapted to be mated with a funnel 22. Sealing area 21 is represented as having three indexing cavities 26A, 26B, and 26C therein. The cavities are preferably peripherally located equidistantly about the faceplate 16; that is, e.g., at 120-degree intervals, as indicated by FIG. 2A. The cavities provide for registering, in conjunction with complementary indexing means, faceplate 16 with funnel 22, as will be described.

Funnel 22 is shown by way of example as having a funnel sealing area 28 with indexing elements 30A, 30B and 30C therein in facing adjacency with indexing cavities 26A, 26B and 26C. Indexing elements 30A, 30B and 30C are in the form of V-grooves, preferably approximately radially oriented with respect to the anteriorposterior axis 30 of tube 12. Ball means 32A, 32B and 32C are conjugate with the cavities 26A, 26B and 26C and V-grooves 30A, 30B and 30C for registering the faceplate 16 and the funnel 22. The indexing means are also utilized for the precision registration of the shadow mask with the faceplate during the photoscreening of the process materials on the faceplate.

Front assembly 15 includes a tension mask support structure 34 secured to the inner surface of faceplate 16 between the screen 20 and the peripheral sealing area 21 of faceplate 16, and enclosing the screen 20. The novel configuration of support structure 34 is an aspect of the front assembly according to the invention, as will be described. Support structure 34 provides for supporting a welded-on tension foil shadow mask 35 a predetermined distance—the "Q" distance 42 indicated in FIG. 3—from the inner surface of faceplate 16. The welding indicated by the associated weldment symbols may be spot-welding. Support structure 34 may for example be attached to the inner surface of the faceplate by a devitrifying glass frit well-known in the art, or by a cold-setting cement such as a Sauereisen-type cement. This concept of a separate metal faceplate support structure and a welded-on tension foil shadow mask is not the subject of the present invention, but is fully described and claimed in referent copending application Ser. No. 832,556 of common ownership herewith.

A neck 36 extending from funnel 22 is represented as housing an electron gun 38 which is indicated as emitting three electron beams 40, 42 and 44 that selectively excite the screen 20 on which is deposited discrete, electron-beam-excitable, colored-light-emitting groups of phosphors. The deposits may be overlayed with a conductive aluminum film (not shown) having a thickness of the order of microns. Beams 40, 42 and 44 serve to selectively excite to luminescence the pattern of phosphor deposits after passing through the parallax barrier formed by shadow mask 35.

Funnel 22 is indicated as having an internal electrically conductive funnel coating 43 adapted to receive a high electrical potential. The potential is depicted as being applied through an anode button 45 to which is attached a conductor 47 which conducts a high electrical potential to the anode button 45 through the wall of the funnel 22. The source of the potential is a high-voltage power supply (not shown). The potential may be for example in the range of 18 to 26 kilovolts in the illustrated monitor application. Means for providing an electrical connection between the electrically conductive metal mask support structure 34 and the funnel coating 43 may comprise spring means 46.

A magnetically permeable internal magnetic shield 48 is shown as being attached to mask support structure 34. A yoke 50 is shown as encircling tube 12 in the region of the junction between funnel 22 and neck 36. Yoke 50 provides for the electromagnetic scanning of beams 40, 42 and 44 across the screen 20.

Figure 4:
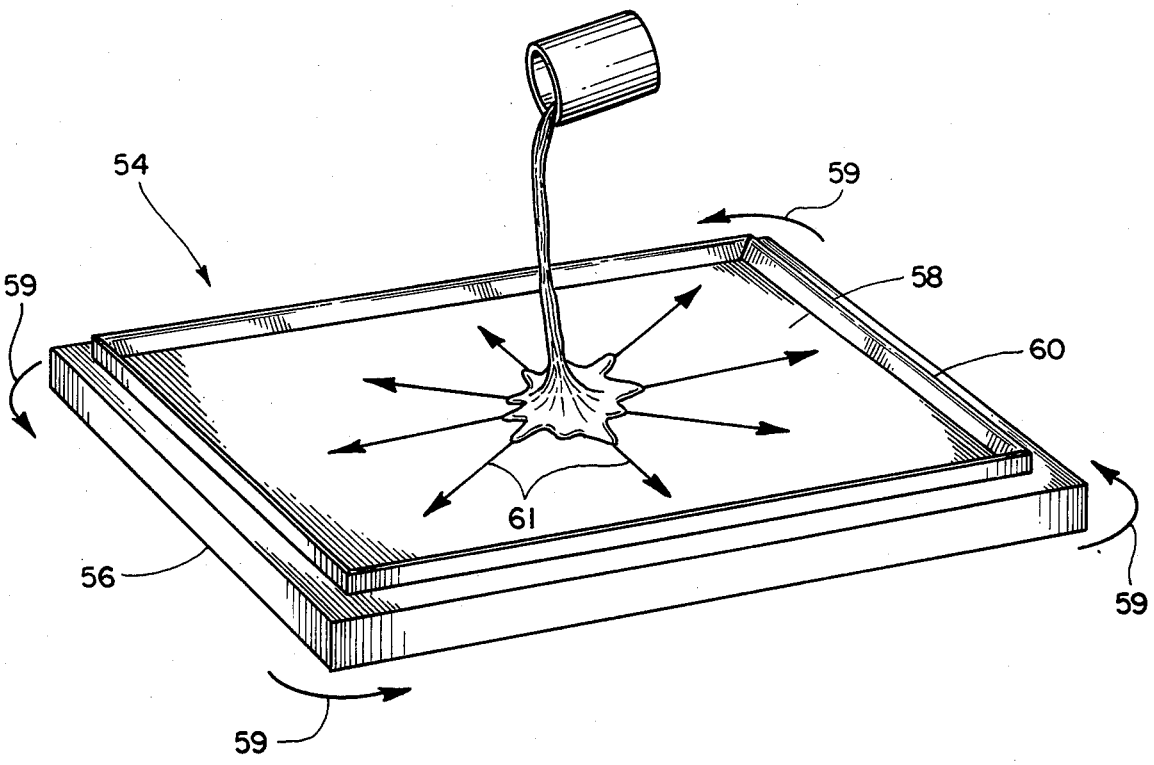
FIG. 4 is an oblique view in perspective of an front assembly according to the invention that indicates diagrammatically the flow of process coating materials during the manufacturing process.

A front assembly for a color cathode ray tube according to the invention is depicted by FIG. 4. The front assembly 54 includes a faceplate 56 having on its inner surface a centrally disposed screen area 58 comprising an uncoated glass surface which receives precess coating materials during the spin-application process. The application of the coating materials is indicated diagrammatically by the cup and the fluid pouring from it onto the center of screen area 58. The rotation of the front assembly for the spin-application process is indicated by the arrows 59, and the outward flow of the fluidized process materials due to centrifugal force is indicated by the center cluster of arrows 61. The rate of rotation may be e.g., in the range of 300 to 600 revolutions per minute. A shadow mask support structure 60 is represented as being secured to the inner surface of the faceplate on opposed sides of screen area 58. Mask support structure 60 is noted as being identical in configuration to mask support structure 34 shown by FIGS. 2 and 3, wherein it is depicted as being installed in tube 12.

Figure 5:
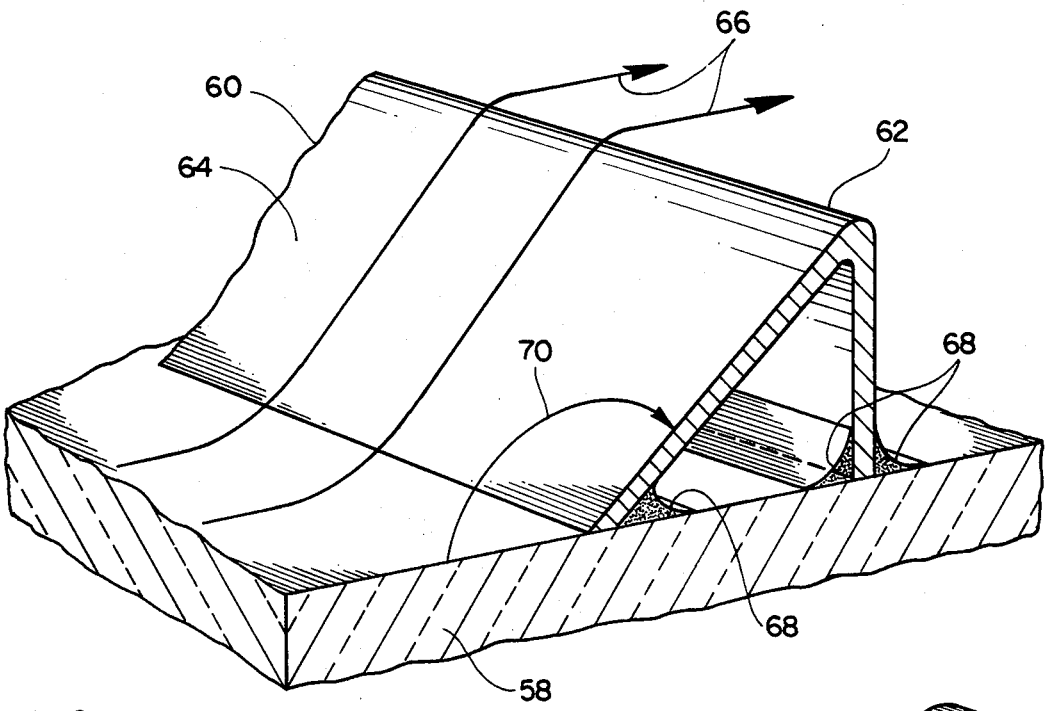
FIG. 5 is a detail perspective view in section of the mask support component of FIG. 4 showing the flow of process coating materials in relation to the component.

The mask support structure 60 is shown in greater detail in FIG. 5. Structure 60 is depicted as having a first surface 62 for receiving and securing a foil shadow mask in tension. In accordance with an aspect of this invention, structure 60 has a second surface 64 inclined from first surface 62 to the screen area 58. The inclination of second surface 64 in accordance with the invention is effective to conduct from screen area 58 any excess of the process coating materials applied during the spin-application process. This conduction is indicated by the arrows 66. As a result, discontinuities in phosphor application, and non-adherence of phosphor resulting in phosphor washoff and flake-off, are avoided, according to the invention.

Mask support structure 60 is depicted in this preferred embodiment of the invention as being hollow and is preferably composed of sheet metal. Structure 60 is shown as being secured to screen area 58 by fillets of cement 68 which may comprise, by way of example, a devitrifying frit. The second surface 64 inclined from first area 62 to screen area 58 is at an obtuse angle according to the invention in the range of 91 degrees to 135 degrees with respect to the plane of the screen area 58, and preferably about 120 degrees, as indicated by angle 70.

Figure 6:
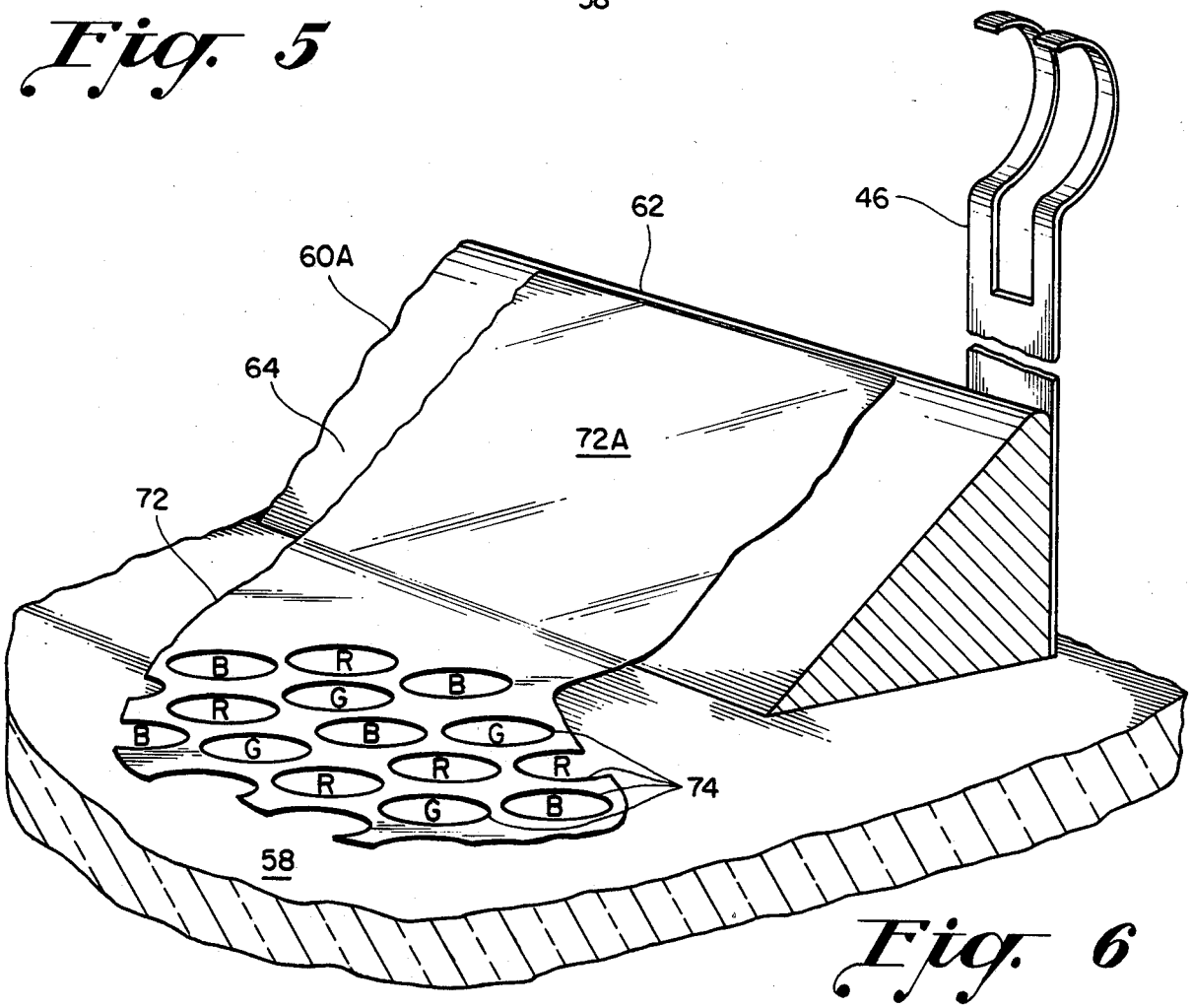
FIG. 6 is a view similar to FIG. 5 depicting the final disposition of process coating materials (not to scale) providing for electrical interconnection of components of the front assembly according to the invention.

Another aspect of the front assembly according to the invention is shown by FIG. 6 wherein the final disposition of the process materials is indicated diagrammatically. Centrally disposed screen area 58 is shown as having a deposit of grille dag 72, noted as being electrically conductive, separating triads of electron-beam-excitable phosphor deposits 74, the colorations of which are indicated by the symbols R, G and B (red, green and blue). The shadow mask support structure is of electrically conductive composition, and is shown in this embodiment of the invention as being solid metal and noted as bearing reference number 60A. Support structure 60A is represented schematically as receiving a high-voltage charge through the aforedescribed spring means 46, noted as being in contact with the inner conductive coating 43 of funnel 22 of tube 12. (Please refer again to FIG. 2.) Support structure 60A is indicated as having a deposit of electrically conductive grille dag thereon extending from and electrically connected with grille dag 72 in screen area 58. In the FIG. 6 embodiment of the front assembly according to the invention, the deposit of grille dag 72A is shown as deposited on second surface 64 which is inclined from first surface 62 to screen area 58. The beneficial result according to this aspect of the invention is that the aluminum film covering screen area 58 is, by its contact with grille dag 72A, charged to the same potential as the electrically charged shadow mask support structure without the need for any ancillary coatings or electrical connection means. The complete electrical circuit in sequence from the high voltage power supply to the screen comprises the following: conductor 47, anode button 45, internal conductive funnel coating 43, spring means 46, internal magnetic shield 48, shadow mask support structure 34, grille dag 72, and aluminum coating 20. As a result, the entire interior of the tube, with the exception of the gun area, is at a common high electrical potential.

With regard to the composition of the mask support structure 34, alloy No. 27 supplied by Carpenter Technology, Inc. of Reading, Pa. is preferred because its coefficient of thermal expansion is compatible with the glass of the faceplate.

It is desirable that first surface 62 have a flat thereon for ensuring positive all-around contact between the shadow mask and the support structure for weld integrity and the maintenance of the proper Q-distance. The flat can be formed by lapping; that is, grinding the surface of the supporting structure (when it is secured to the faceplate) against a flat surface having an abrasive thereon. The extent of the flat according to the invention is in the range of 3 to 120 mils. The lapping has another benefit in that all grille dag and contaminants which would otherwise interfere with proper welding are removed from the first surface.

As noted, the process of securing the mask 35 to the frame is preferably accomplished by electrical resistance welding. Laser welding is also a viable alternative. For a tube of 14 inch diagonal measure, as many as a thousand such welds at intervals of about 0.040 inch are recommended to ensure positive securement of the mask to the frame.

While a particular embodiment of the invention has been shown and described, it will be readily apparent to those skilled in the art that changes and modifications may be made in the inventive means and method without departing from the invention in its broader aspects, and therefore, the aim of the appended claims is to cover all such changes and modifications as fall within the true spirit and scope of the invention.

I claim:

1. A front assembly for a color cathode ray tube including a faceplate having on its inner surface a centrally disposed screen area for receiving process coating materials during a spin-application process, said front assembly having a shadow mask support structure secured to said inner surface on opposed sides of said screen area, said mask support structure having a first surface for receiving and securing a foil shadow mask and a second surface inclined from said first surface to said screen area effective to conduct from said screen area any excess of coating material applied during the spin-application process, thereby avoiding discontinuities in phosphor application visible to the viewer, and non-adherence of phosphor resulting in phosphor wash-off and flake-off.

2. A front assembly according to claim 1 wherein said mask support structure is of metal composition.

3. A front assembly according to claim 2 wherein said metal structure is hollow and composed of sheet metal.

4. A front assembly according to claim 1 wherein said structure is a solid metal.

5. A front assembly according to claim 1 or claim 3 wherein the the inclination of said second surface is in the range of 91 degrees to 135 degrees with respect to the plane of the screen area.

6. A front assembly according to claim 5 wherein the inclination of said second surface is preferably about 120 degrees.

7. A front assembly for a color cathode ray tube including a faceplate having on its inner surface a centrally disposed screen area for receiving process coating material during a spin-application process, said front assembly having a sheet metal shadow mask support structure secured to said inner surface on opposed sides of said screen area, said mask support structure having a first surface for receiving and securing a foil shadow mask and a second surface inclined in the range of 91 degrees to 135 degrees from said first surface to said screen area as measured with respect to the plane of the faceplate, said inclined surface being effective to conduct from said screen area any excess of process coating material applied during the spin-application process, thereby avoiding discontinuities in phosphor application visible to the viewer, and non-adherence of phosphor resulting in phosphor wash-off and flake-off.

8. A front assembly according to claim 7 wherein the inclination of said second surface is preferably about 120 degrees.

9. A front assembly for a color cathode ray tube including a faceplate having on its inner surface a centrally disposed screen area with a deposit of electrically conductive dag thereon separating triads of electron-beam-excitable phosphor deposits, said front assembly having an electrically charged shadow mask support structure secured to said inner surface on opposed sides of said screen area with a first surface for receiving a foil shadow mask in tension, said support structure further including a second surface inclined from said first surface to said screen area, said surface having a deposit of said electrically conductive dag thereon extending from and electrically connected with said dag in said screen area, whereby said screen area is charged to the same potential as said electrically charged shadow mask support structure.

* * * * *